US007862092B2

(12) United States Patent
Jaktlund et al.

(10) Patent No.: US 7,862,092 B2
(45) Date of Patent: Jan. 4, 2011

(54) DOOR LOCK AND METHOD FOR MANUFACTURING SAID DOOR LOCK

(75) Inventors: Nils-Gunnar Jaktlund, Linköping (SE); Lars Löfgren, Linköping (SE)

(73) Assignee: Saab AB, Linköping (SE)

( * ) Notice: Subject to any disclaimer, the term of this patent is extended or adjusted under 35 U.S.C. 154(b) by 1076 days.

(21) Appl. No.: 10/556,675

(22) PCT Filed: May 14, 2004

(86) PCT No.: PCT/SE2004/000745

§ 371 (c)(1),
(2), (4) Date: Nov. 24, 2006

(87) PCT Pub. No.: WO2004/104345

PCT Pub. Date: Dec. 2, 2004

(65) Prior Publication Data

US 2007/0090657 A1 Apr. 26, 2007

(30) Foreign Application Priority Data

May 20, 2003 (SE) ..... 0301469

(51) Int. Cl.
*E05C 19/00* (2006.01)
*E05C 19/18* (2006.01)

(52) U.S. Cl. ..... 292/301; 292/1; 292/260; 292/DIG. 11

(58) Field of Classification Search ..... 292/1, 292/43, 55, 90, 105, 115, 155, 176, 206, 292/212, 256.71, 256.73, 260, 291, 293, 292/294, 301, DIG. 11; 70/229–232
See application file for complete search history.

(56) References Cited

U.S. PATENT DOCUMENTS

| | | | | | |
|---|---|---|---|---|---|
| 391,357 | A | * | 10/1888 | Devers | 292/155 |
| 748,078 | A | * | 12/1903 | Kaisling | 292/251 |
| 1,131,886 | A | * | 3/1915 | Wisterman | 292/251 |
| 1,344,456 | A | * | 6/1920 | Schroeder | 292/251 |
| 1,440,872 | A | * | 1/1923 | Geurink | 292/155 |
| 2,326,282 | A | * | 8/1943 | Bierenfeld | 292/301 |
| 2,460,613 | A | * | 2/1949 | Whelan et al. | 292/251 |

(Continued)

FOREIGN PATENT DOCUMENTS

DE 19929242 A1 12/2000

(Continued)

*Primary Examiner*—Carlos Lugo
(74) *Attorney, Agent, or Firm*—Venable LLP; Eric J. Franklin

(57) ABSTRACT

A door lock for locking a door to an underlying structure. A machine element disposed in connection to a through opening in the underlying structure is arranged so as to engage a bolt that is insertable into a through opening in the door. The machine element is inserted through the opening in the underlying structure to a position at which the openings in the door and the underlying structure form, together with the part of the machine element that extends outside of the underlying structure, a length that is longer than the bolt length, while at the same time an internal thread on the machine element extends sufficiently far through the underlying structure that, with the joint mounted, it engages the bolt to create the joint. Also, a method for manufacturing the door lock.

18 Claims, 2 Drawing Sheets

U.S. PATENT DOCUMENTS

| | | | | | |
|---|---|---|---|---|---|
| 2,691,543 | A | * | 10/1954 | Morand | 292/1 |
| 2,732,234 | A | * | 1/1956 | Lundell | 292/1 |
| 2,772,906 | A | * | 12/1956 | Esmond | 292/212 |
| 2,991,904 | A | * | 7/1961 | Carideo | 220/231 |
| 3,244,212 | A | * | 4/1966 | Barry | 411/361 |
| 3,250,559 | A | * | 5/1966 | Sommerfeld | 292/251 |
| 3,302,434 | A | * | 2/1967 | Dauenhaugh et al. | 70/208 |
| 3,343,581 | A | * | 9/1967 | Martin et al. | 411/349 |
| 3,550,412 | A | * | 12/1970 | Silverman et al. | 70/461 |
| 3,782,146 | A | * | 1/1974 | Franke | 70/232 |
| 4,061,373 | A | * | 12/1977 | Revell | 292/251 |
| 4,760,721 | A | * | 8/1988 | Steinbach | 70/208 |
| 5,152,161 | A | * | 10/1992 | Lee | 70/127 |
| 5,269,161 | A | * | 12/1993 | Stillwagon | 70/34 |
| 5,960,653 | A | * | 10/1999 | DeWalch et al. | 70/164 |
| 6,588,242 | B1 | * | 7/2003 | Beaty | 70/231 |

FOREIGN PATENT DOCUMENTS

| | | | | |
|---|---|---|---|---|
| GB | 2227517 | A | * | 8/1990 |
| SE | 8405392-5 | A | | 4/1986 |

* cited by examiner

DOOR LOCK AND METHOD FOR MANUFACTURING SAID DOOR LOCK

TECHNICAL AREA

This invention concerns a door lock for locking a door to an underlying structure.

The invention also concerns a method for manufacturing a door lock.

STATE OF THE ART

The manufacture of complex structures such as airplanes requires access to a large number of components. For example, airplanes contain a number of doors of various types to equipment compartments and the like. A bolt that passes through an opening in the door and underlying structure and a nut that is fixedly mounted on the underlying structure are customarily used as locks for such doors. In airplane applications it is important that the doors be electrically impermeable and rigidly joined to the rest of the structure. Electrically impermeable doors require that the nut that is used must be sealed at one end to keep the bolt enclosed inside the nut; otherwise there is a risk that antenna effects will occur in the bolt.

An airplane contains a number of doors with underlying structures of various thicknesses, thereby necessitating the administration and stock-keeping of a large number of bolt lengths with associated nut components.

DESCRIPTION OF THE INVENTION

One object of the present invention is to reduce the range of bolts needed.

This has been achieved by means of a door lock for locking a door to an underlying structure, wherein a machine element disposed in connection to a through opening in the underlying structure is arranged so as to engage a bolt that is insertable into a through opening in the door. The door lock is characterized in that the machine element is inserted through the opening in the underlying structure to a position at which the openings in the door and the underlying structure form, together with the part of the machine element that protrudes outside of the underlying structure, a length that is longer than the bolt length. An internal thread realized in the machine element must simultaneously extend sufficiently far through the underlying structure that, with the joint mounted, it engages around the bolt to form the joint. The invention also comprises a method for manufacturing a door lock as per the foregoing.

Preferred embodiments possess one or more of the characterizing features described in the subordinate claims.

With the door lock and method according to the invention, only one bolt length is necessary for a large number of material thicknesses, with the administrative and financial advantages that this entails. Furthermore, the door lock obtained with the method according to the invention is well suited for use in aircraft applications, in that it can tolerate being opened and closed very large number times. The lock also transfers loads acting on the door and loads acting between the door and the rest of the structure.

PREFERRED EMBODIMENTS

Figure 1:
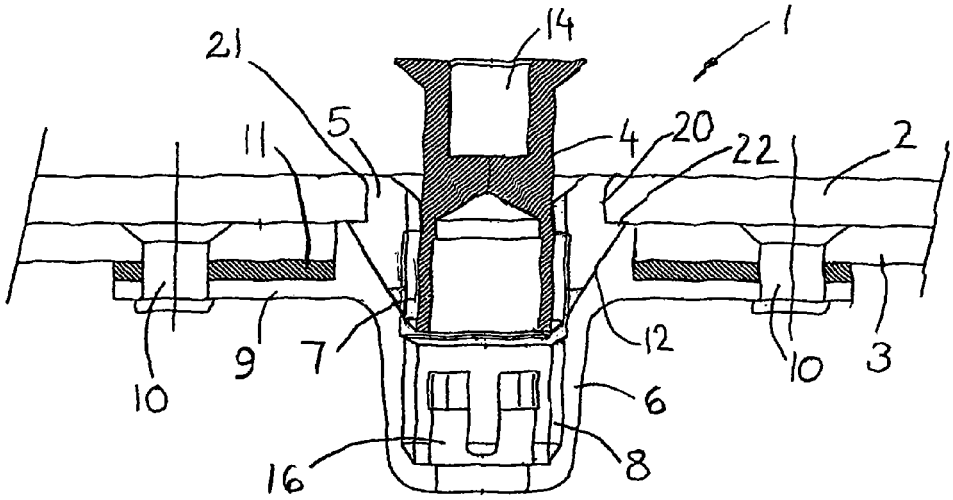
FIG. 1 shows a section through an example of a bolt joint in an unmounted position.
Figure 2:
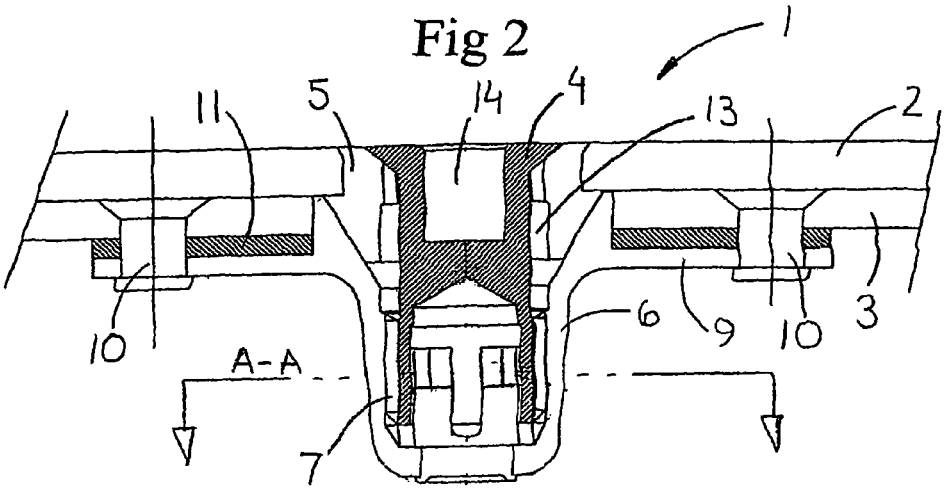
FIG. 2 shows a section through the bolt joint in FIG. 1 in a mounted position.
Figure 3:
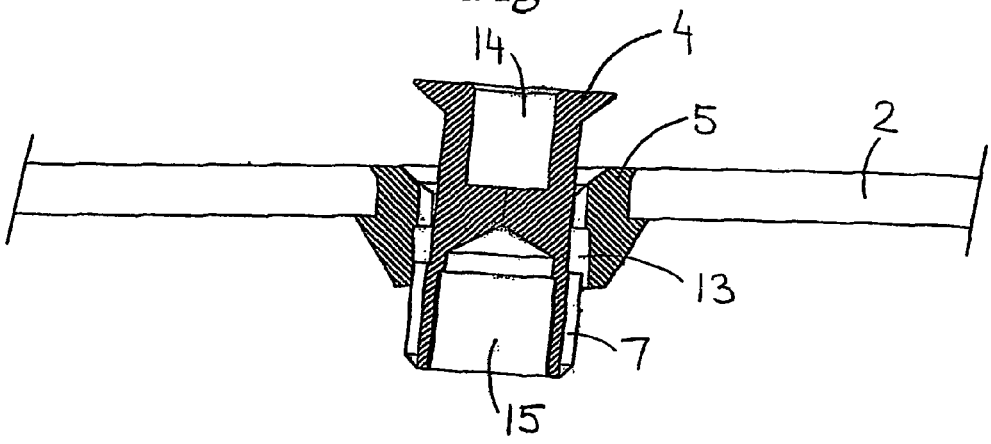
FIG. 3 shows a section through a part of the bolt joint in FIG. 1.

In FIGS. 1 and 2, reference number 1 designates a bolt joint that removably and fixedly secures a first structure 2 to a second structure 3. The bolt joint is disposed in a respective opening in the structures 2, 3. In the unrestricted example described below, the first structure 2 is a door and the second structure 3 is a doorframe, whereupon the bolt joint 1 is thus a door lock. The joint can conceivably be used as a door lock on, e.g. aircraft.

The bolt joint comprises a bolt 4, a bushing 5 and a machine element 6. The bushing 5 is disposed in the through opening in the door, and the machine element 6 is disposed in the through opening in the doorframe. The bolt 4 has a threaded part 7 and the machine element 6 has, internally, a thread 8 that complements said threaded part 7. The length of the bolt is chosen so as to enable its use on a door with a specified maximum thickness. On the other hand, it is inconsequential whether the bolt is shorter than the total thickness of the door and the door lock, as will be described below. In particular, the threaded part 7 need not extend in its entirety beyond the doorframe when the bolt is screwed all the way in.

The machine element 6 is partly introduced through the opening in the doorframe so that a first section of the machine element extends beyond the doorframe 3 and a second section of the machine element is disposed inside the doorframe. The first section comprises walls and a bottom, essentially enclosing the opening in the doorframe so that the doorframe surface with the first section of the machine element is essentially electrically impermeable. The second section is designed so as to essentially lie in abutment to the walls of the doorframe. A flange 9 realized in the machine element lies in abutment to the surface of the doorframe. The flange 9 functions as the boundary between the first and the second section, and ensures that the first section is not inserted into the opening in the doorframe 3. The machine element 6 in the example shown is mounted to the doorframe by means of rivets 10. The number of rivets 10 is, e.g. 2, 3 or 4. However, other methods of mounting the machine element to the doorframe 3 are conceivable, such as welding or gluing. An intermediate disk 11 is disposed between the flange 9 and the doorframe 3 in the example shown. The placement of the flange 9 on the machine element is chosen so that the machine element 6 is, on the one hand, not inserted into the doorframe further than would permit the entire bolt length to be screwed into the door, while simultaneously on the other hand, a sufficient large part of the machine element must be inserted into the doorframe so that, with the bolt fully inserted, the thread of the bolt and the thread of the machine element engage one another. When the bolt is fully inserted into the opening, a degree of play must exist between the bottom of the machine element and the bolt. The length of the bolt is thus constant, while the placement of the flange 9 on the machine element is determined by the thickness of the door and the doorframe. As a result, all the bolt joints in a unit, such as an airplane, can comprise bolts of a given, preselected bolt length.

The bushing in the example shown comprises a first section with a neck 20 and a flange part 21, 22 disposed on each side of the neck, where the length of the neck is determined by the door thickness, so that the flange parts 21, 22 lie in abutment to the shell surfaces of the door. A second section of the bushing extends from the door and into the opening in the doorframe when the joint is in its mounted position. The second sections of the bushing 5 and the machine element are moreover designed so that, in the mounted position, adjacent surfaces 12 lie in tight abutment to one another, i.e. the bushing 5 bottoms in the machine element 6. The bushing 5 is internally equipped with a thread 13 that complements that threading of the bolt so as, with the bolt joint unmounted, to hold the bolt 4 fixedly in the door by screwing it through the bolt and into the thread 13 realized in the bushing. There is thus no risk that the bolt 4 will be lost with the bolt joint unmounted.

A non-through axial notch 14 is realized at the head of the bolt 4. The notch 14 is intended to receive a tool, such as a screwdriver, in order to screw the bolt 4 into the machine element 6. An additional non-through axial notch 15 is realized at the opposite end of the bolt. In the example shown, a bifurcate recess 16 that extends into the machine element is disposed in the end of the machine element opposite the open end facing toward the bolt.

The notch 15 is designed to receive the bifurcate recess 16. The length of the bifurcate recess 16 is either less than or equal to the length of the corresponding notch 15, and designed to press against the lateral walls of the 15 along the entirety of its length or parts of its length with the bolt joint mounted, so as to hold the bolt in its position. In this way the bolt 4 avoids the risk of coming unscrewed from the machine element 6 if, e.g. the joint is subjected to strong vibrations; this is particularly important if the bolt is not properly screwed in. Designs other than those involving a bifurcate recess are also conceivable to realize the engagement between the bolt and the nut. It is however advantageous if the projecting part is threaded to some extent.

Figure 4:
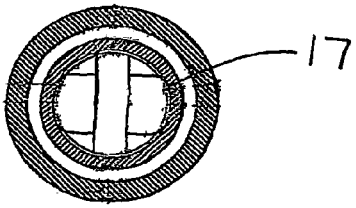
FIG. 4 shows a cross-section along A-A in FIG. 1 according to a first embodiment.

In FIG. 4, the engagement between the lateral walls of the notch 15 and the bifurcate recess 16 is realized solely by friction force. The engagement surfaces 17 are thus fiat. The engagement surfaces can be made of steel or another suitable material.

Figure 5:
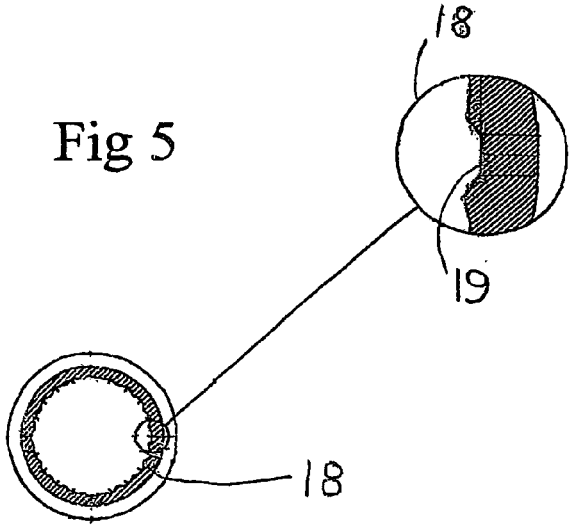
FIG. 5 shows a cross-section along A-A in FIG. 1. according to a second embodiment.

In FIG. 5 the surfaces that lie in abutment to one another in the notch 15 are designed so as to realize the engagement by means of a snap-in coupling. The engagement surfaces 18 in the notch 15 comprise a number of axially oriented indentations 19, and the recess has complementarily designed protrusions, whereupon the slot engages in the notch by "snapping" into the indentations.

A method for manufacturing the aforedescribed door lock entails that the bolt, which has a predetermined length, is provided for insertion into the through opening in the door, that the machine element arranged to engage the bolt is disposed in connection with the through opening of the doorframe in a position in which the openings in the door and the doorframe form, together with the part of the machine element that extends from the doorframe, a length that is longer than the bolt length, while at the same time the machine element extends sufficiently far through the doorframe that, with the joint mounted, it engages the bolt to form the joint.

The invention claimed is:

1. A door lock for locking a door to an underlying structure, the door lock comprising:

a machine element connected to the underlying structure, the machine element comprising flange portions extending from a receiving portion, the receiving portion comprising first and second end portions extending outwardly from the flange portions in opposite directions, the first end portion being positioned in an opening of the underlying structure and the flange portions being connected to an inside surface of the underlying structure next to the underlying structure opening, the first end portion comprising inclined surfaces creating a receiving part and the second end portion comprising internal threads;

a bushing element securely arranged in an opening of the door, the bushing comprising an inclined protruding part and a channel; and a bolt member comprising a head portion and a threaded end portion;

wherein, when the door is moved toward a locking position within the underlying part of the receiving portion so that the bolt member can be inserted therethrough, so as to threadedly engage the bolt member with the threads of the second end portion of the receiving portion, locking the door against the underlying structure.

2. The door lock according to claim 1, wherein the flange portions of the machine element comprise an external radial flange.

3. The door lock according to claim 2, wherein the external radial flange is arranged on the machine element such that with the door lock in a locked position a head of the bolt substantially bottoms in the door and a degree of play exists between an opposite end of the bolt and a bottom in the machine element.

4. The door lock according to claim 1, wherein the bushing comprises an internal thread that is complementarily designed with external thread of the bolt so as to fixedly hold the bolt in the door with the lock unlocked.

5. The door lock according to claim 4, wherein the bushing forms an extension of the machine element with the lock locked.

6. The door lock according to claim 1, wherein the bolt further comprises a non-through notch in an end distal to a head of the, wherein the machine element further comprises complementary elements, and wherein when the complementary elements are inserted into the notch the complementary elements abut lateral walls of the notch so as to hold the bolt fixedly in place with the door lock locked.

7. The door lock according to claim 6, wherein the complementary elements hold the bolt fixedly in place with a friction coupling.

8. The door lock according to claim 6, wherein the complementary elements hold the bolt fixedly in place with a snap-in coupling.

9. The door lock according to claim 3, further comprising:

rivets configured to fix the machine element to the underlying structure.

10. A method for locking a door to an underlying structure, the method comprising:

providing a machine element connected to the underlying structure, the machine element comprising flange portions extending from a receiving portion, the receiving portion comprising first and second end portions extending outwardly from the flange portions in opposed directions, the first end portion being positioned in an opening of the underlying structure and the flange portions being connected to an inside surface of the underlying structure next to the underlying structure opening, the first end portion comprising inclined surfaces creating a receiving part and the second end portion comprising internal threads;

providing a bushing element securely arranged in an opening of the door, the bushing comprising an inclined protruding part and a channel; and providing a bolt member comprising a head portion and a threaded end portion;

wherein, when the door is moved toward a locking position within the underlying structure, the protruding part of the bushing member is received in the receiving part of the receiving portion so that the bolt member can be inserted therethrough, so as to threadably engage the bolt member with the threads of the second end portion of the receiving portion, locking the door against the underlying structure.

11. The method according to claim 10, wherein the flange elements comprise an external radial flange, the method further comprising:

bringing the external radial flange into abutment with a surface of the underlying structure.

12. The method according to claim 11, wherein the external radial flange is arranged on the machine element such that with the door lock in a locked position a head of the bolt substantially bottoms in the door and a degree of play exists between an opposite end of the bolt and a bottom in the machine element.

13. The method according to claim 10, wherein the bushing comprises an internal thread that is complementarily designed with external thread of the bolt so as to fixedly hold the bolt in the door with the lock unlocked.

14. The method according to claim 13, wherein the bushing forms an extension of the machine element with the lock locked.

15. The method according to claim 10, wherein the bolt comprises a non-through notch in an end distal to a head of the, wherein the machine element comprises complementary elements, the method further comprising:

inserting the complementary elements into the notch such that the complementary elements abut lateral walls of the notch so as to hold the bolt fixedly in place with the door lock locked.

16. The method according to claim 15, wherein the complementary elements hold the bolt fixedly in place with a friction coupling.

17. The method according to claim 15, wherein the complementary elements hold the bolt fixedly in place with a snap-in coupling.

18. The method according to claim 10, further comprising:

fixedly riveting the machine element to the underlying structure.

* * * * *